US011594839B2

(12) United States Patent
Hofmann

(10) Patent No.: US 11,594,839 B2
(45) Date of Patent: Feb. 28, 2023

(54) PLUG CONNECTOR ASSEMBLY

(71) Applicant: MD Elektronik GmbH, Waldkraiburg (DE)

(72) Inventor: Thomas Hofmann, Tacherting (DE)

(73) Assignee: MD ELEKTRONIK GMBH, Waldkraibug (DE)

( * ) Notice: Subject to any disclaimer, the term of this patent is extended or adjusted under 35 U.S.C. 154(b) by 35 days.

(21) Appl. No.: 17/491,616

(22) Filed: Oct. 1, 2021

(65) Prior Publication Data

US 2022/0123502 A1 Apr. 21, 2022

(30) Foreign Application Priority Data

Oct. 15, 2020 (DE) ..... 10 2020 127 203.0

(51) Int. Cl.
*H01R 13/627* (2006.01)
*H01R 13/639* (2006.01)

(52) U.S. Cl.
CPC ..... *H01R 13/6272* (2013.01); *H01R 13/639* (2013.01)

(58) Field of Classification Search
CPC ..... H01R 13/6272; H01R 13/639
See application file for complete search history.

(56) References Cited

U.S. PATENT DOCUMENTS

| | | | | |
|---|---|---|---|---|
| 5,120,255 | A * | 6/1992 | Kouda | H01R 13/641 439/489 |
| 5,624,271 | A * | 4/1997 | Childs | H01R 13/6272 439/352 |
| 9,054,458 | B1 | 6/2015 | Ng | |
| 10,135,172 | B1 * | 11/2018 | Foltz | H01R 13/6272 |
| 10,355,414 | B1 | 7/2019 | Alvarado | |
| 10,855,025 | B2 * | 12/2020 | Holub | H01R 13/641 |
| 11,342,708 | B2 * | 5/2022 | Menez | H01R 13/6272 |
| 2009/0023325 | A1 | 1/2009 | Chen et al. | |
| 2020/0313348 | A1 * | 10/2020 | Liu | H01R 13/639 |
| 2022/0123502 | A1 * | 4/2022 | Hofmann | H01R 13/6272 |

FOREIGN PATENT DOCUMENTS

| | | | |
|---|---|---|---|
| DE | 4016114 | C2 | 10/1993 |
| DE | 112017001349 | T5 | 11/2018 |

* cited by examiner

*Primary Examiner* — Neil Abrams
(74) *Attorney, Agent, or Firm* — Leydig, Voit & Mayer, Ltd.

(57) ABSTRACT

A plug connector assembly for a cable includes a plug-in unit, a mating plug-in unit and a securing unit with a base part. A housing of the plug-in unit has a latching element having a free end with a latch that can be latched to a latching seat. In a released position of the securing unit, the base part abuts a bar of the plug-in unit so that movement into a locked position is blocked. The mating plug-in unit has a deflection element that deflects the base part and positions a groove in alignment with the bar, so that the bar is insertable into the groove, and the securing unit is movable into the locked position in which a locking element blocks a movement of the free end, and prevents the latch from leaving the latching seat.

13 Claims, 3 Drawing Sheets

PLUG CONNECTOR ASSEMBLY

CROSS REFERENCE TO RELATED APPLICATIONS

This application claims benefit to German Patent Application No. DE 10 2020 127 203.0, filed on Oct. 15, 2020, which is hereby incorporated by reference herein.

FIELD

The invention relates to a plug connector assembly having a plug-in unit, a securing unit and a mating plug-in unit, in particular for connecting at least one cable to a component, in particular an electrical component.

BACKGROUND

For detachably connecting at least one cable to another component, such as a semiconductor circuit board or another cable, plug connectors are generally used. Plug connectors have contact parts that are connected to the electrically conductive wires of the cable, or to the electrically conductive elements of the component to be connected. In order to establish an electrical connection between the cable and the component to be connected, the contact parts are connected to one another in an electrically conductive, detachable manner. Furthermore, a plug connector has a connector housing connected to the cable and a mating connector housing connected to the component to be connected. The connector housing and mating connector housing can likewise be detachably connected to one another in order to create an additional mechanical connection which, on the one hand, protects the conductive connection of the contact parts, stabilizes the connection of the contact parts, and protects them from external influences. If the connection between the plug-in housing and the mating plug-in housing takes place by means of a form fit, for example via snap-in connections, a so-called plug connector position securing means can be necessary, which prevents undesired or unintentional release of the snap-in connection. Such plug connector position securing means are known, for example, from the documents U.S. Pat. No. 9,054,458 B1, U.S. Ser. No. 10/355,414 B1 and DE 11 2017 001 349 T5.

SUMMARY

In an embodiment, the present disclosure provides a plug connector assembly for a cable. The plug connector assembly includes a plug-in unit having at least one contact element and a connector housing at least partially surrounding the contact element, as well as a mating plug-in unit and a securing unit. The plug-in unit is connectable to the mating plug-in unit on a plug-in side. The connector housing has a latching element which is arranged on a base side adjacent to the plug-in side and has at least one free end which extends at a distance from the base side and counter to a plug-in direction. On a side facing away from the connector housing, the free end has a latch which, in a connected position where there is a connection between the plug-in unit and the mating plug-in unit, is configured to latch to a latching seat arranged on the mating plug-in unit. The securing unit is movable between a released position and a locked position. The securing unit has a base part which is arranged at least partially between the free end and the base side. In the released position, the base part abuts a bar of the plug-in unit in a disconnected state where the plug-in unit and mating plug-in unit are disconnected so that a movement of the securing unit into the locked position is blocked. The mating plug-in unit has a deflection element which is configured to deflect the base part when the plug-in unit is moved to the connected position and to position a groove, arranged in a side of the base part facing the base side, in alignment with the bar, so that the bar is insertable into the groove, and the securing unit is movable into the locked position. The securing unit has a locking element which, in the locked position, is arranged between the free end and the base side and blocks a movement of the free end toward the base side, and prevents the latch from leaving the latching seat

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
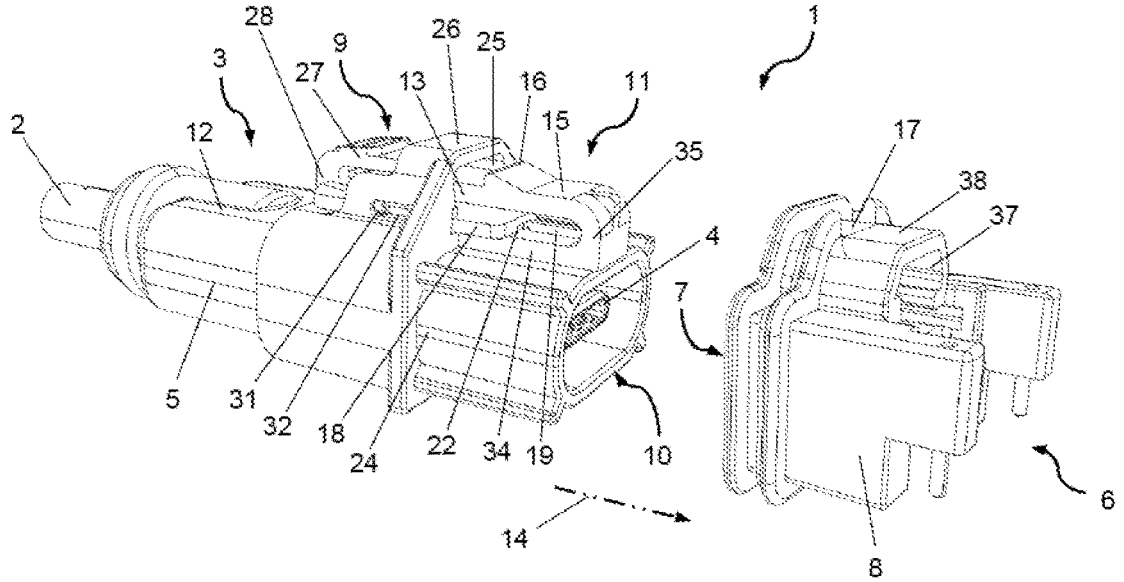
FIG. 1 a first embodiment of a plug connector assembly according to the invention in a three-dimensional view.

The plug connector assemblies known in the prior art have the disadvantage that they have a high degree of complexity in order to be able to meet the requirements placed on plug-in connections. The production effort and the associated costs of the known plug connector position securing means are therefore correspondingly high.

In an embodiment, the present invention overcomes at least one disadvantage of the prior art and provides a plug connector assembly which has a plug connector position securing means with a significantly lower degree of complexity without having to dispense with essential functions of the plug connector position securing means.

A plug connector assembly according to embodiments of the invention is suitable for a cable. The plug connector assembly can therefore be used to conductively connect the cable to another component. The component can be, for example, a semiconductor circuit board or another cable. The cable can be both a single-wire cable and a multi-wire cable for data and/or power transmission. The plug connector assembly according to an embodiment of the invention comprises a plug-in unit. The plug-in unit has at least one contact element. Furthermore, the plug-in unit comprises a connector housing which at least partially surrounds the contact element. The contact element can be connected to one or more data- and/or current-carrying lines of the cable. In particular, the region of the contact element in which the contact element is connected to the lines of the cable can be surrounded by the connector housing in order to protect the connection between the cable and the lines from external influences. The connector housing can also be connected to the cable. The plug connector assembly furthermore comprises a mating plug-in unit. The mating plug-in unit can have a mating contact element. The mating contact element can be connected to one or more data- and/or current-carrying lines of another component. The other component can be, for example, another cable or a semiconductor circuit board. The mating contact element can be at least partially surrounded by a mating connector housing. Furthermore, the mating connector housing can be mechanically connected to the component. The plug-in unit can be connected to the mating plug-in unit on a plug-in side. The contact element can be detachably connected to the mating contact element on the plug-in side so that data and/or current transmission between the cable and the component is made possible. The connector housing can likewise be at least mechanically connected to the mating connector housing on the plug-in side and/or on a side adjacent to the plug-in side in order to create a mechanically stable and durable connection between the plug-in unit and the mating plug-in unit.

The connector housing may have a latching element which is arranged on a base side adjacent to the plug-in side. The base side can be a side which connects the plug-in side to a cable side on which the cable is connected to the plug connector assembly. The latching element has at least one free end which extends at a distance from the base side and counter to a plug-in direction. In this context, "plug-in direction" can be understood to mean the direction in which the plug-in unit must be brought to the mating plug-in unit in order to connect the plug-in unit to the mating plug-in unit on the plug-in side. The distance that the free end has from the base side can become greater as the distance from the plug-in side increases. Furthermore, it is preferred that the latching element is arranged on the base side adjacent to the plug-in side. On a side facing away from the plug-in housing, the free end of the latching element has a latch which, when there is a connection between the plug-in unit and the mating plug-in unit, can be latched to a latching seat arranged on the mating plug-in unit. The latch can be designed, for example, as a hook, and the latching seat can be designed, for example, as a recess or as a latching tab, so that the latching can take place, for example, by the hook snapping into the recess. The latching can preferably be released by moving the free end of the latching element toward the base side.

The plug connector assembly has a securing unit. The securing unit can be moved between a released position and a locked position, in particular on the base side and preferably parallel to the plug-in direction. The securing unit has a base part which is arranged at least partially between the free end of the latching element and the base side. The base part is preferably arranged at least partially between the free end of the latching element and the base side of the connector housing both in the released position and in the locked position. In the released position, the base part abuts a bar of the plug-in unit when the plug-in unit and mating plug-in unit are disconnected so that a movement of the securing unit into the locked position is blocked. The bar preferably runs parallel to a movement axis along which the securing unit is moved between the released position and the locked position. "Disconnected" in this context can be understood to mean that the plug-in unit is spaced apart from the mating plug-in unit at least to such an extent that the contact element is separated from the mating contact element, and in particular there is no data- and/or current-carrying connection between the contact element and the mating contact element. At this position, it is preferred that the base part abuts the bar with a side which runs perpendicular to the movement axis.

The mating plug-in unit has a deflection element that deflects the base part upon a connection of the plug-in unit to the mating plug-in unit. On a side facing the base side of the connector housing, the base part has a groove which is positioned in alignment with the bar by the deflection of the base part. As a result, the bar can be inserted into the groove, and the securing unit can be moved into the locked position. Since the bar can be inserted into the groove, the base part can be guided over the bar. It is preferred that the groove has a greater width than the bar, and the groove has a depth which is greater than a height of the bar. The base part is deflected in particular immediately during the connection of the plug-in unit and mating plug-in unit. In this case, the base part is preferably deflected at least partially in a direction which runs perpendicular to the plug-in direction. The deflection element may, for example, be designed as a structural embodiment of the mating connector housing. For example, the mating connector housing can have an inclined surface in relation to the base part, on which surface the base part slides during connection and is thereby deflected.

The securing unit has a locking element which, in the locked position, is arranged between the free end of the latching element and the base side of the connector housing and blocks a movement of the free end in the direction of the base side. The locking element thereby prevents the latch from leaving the latching seat. In the locked position, the free end preferably at least partially touches the free end of the latching element. Furthermore, it is preferred that the free end of the latching element can be moved past the locking element in the released position toward the base side. In the released position, the locking element is thus preferably offset and not arranged between the base side and the free end of the latching element.

With the aid of the plug connector assembly according to an embodiment of the invention, a cable, in particular an electrical cable, can be connected to a component, in particular an electrical component, wherein an undesired release of the connection is additionally prevented by the securing unit. At the same time, the degree of complexity of the connecting device can be kept low, which reduces the production effort and thus the arising costs of the plug connector assembly without having to accept disadvantages with the functionality of the plug connector assembly.

In order to additionally increase the application range of the plug connector assembly according to an embodiment of the invention, the plug-in unit can have a coding housing. The coding housing at least partially surrounds the connector housing. The connector housing can thus be arranged at least partially within the coding housing. The coding housing is preferably detachably fastened to the connector housing. The fastening can be realized, for example, with the aid of a snap-in connection. The coding housing can have coding elements, for example in the form of elevations and depressions, which can be brought into engagement with corresponding coding elements in the mating plug-in unit. The coding elements make it possible to ensure that a plug-in unit with a coding housing can only be brought into connection with a mating plug-in unit, the coding elements of which correspond to the coding elements of the coding housing. In this way, the risk of an incorrect connection can be reduced. Since the coding housing is detachably arranged on the connector housing, the connector housing can be produced as a common part, which additionally lowers the production effort of the connector housing.

The coding housing may have a first clip forming a first passage. The free end of the latching element may extend through the first passage. It is advantageous if the first clip is formed from the same material as and in one piece with the coding housing. Furthermore, it is preferred that the first clip is arranged at a distance from the free end of the latching element.

The securing unit can have a cover part which is arranged at least partially between the first clip and the free end of the latching element. In this connection, it is particularly preferred that the cover part is arranged between the first clip and the free end of the latching element both in the released position and in the locked position. Furthermore, it is preferred that the free end of the latching element can be moved in the direction of the base side by means of the cover element. This can be done, for example, by applying a mechanical force to the cover part, which force bends the cover part toward the base side. As a result of the bending toward the base side, the cover part can apply a force to the free end, which force moves the free end toward the base side.

The cover part of the securing unit can be connected to the base part via a connecting section. The locking element is preferably also arranged on the connecting section. It is particularly preferred that the locking element is arranged on the connecting section between the base part and the cover part.

In addition, the securing unit can have two elastic fastening arms, in particular arranged parallel to one another. The fastening arms can have a guide pin on the side facing the respective other fastening arm. The guide pins of the two fastening arms are preferably arranged on a common axis. For each guide pin, the plug-in unit has a guide path in which the guide pin is guided. The guide paths are preferably arranged parallel to one another and preferably run linearly, i.e. in a straight line. If the plug-in unit has a coding housing, it is particularly preferred that the guide paths are arranged in the coding housing. It is furthermore preferred that the fastening arms are pretensioned against the respective guide path in which the respective guide pin is guided.

The guide paths may have at least two opposing indentations. The width of the guide path between the opposing indentations is preferably smaller than the diameter of the guide pin arranged in the guide path. The width of the guide path outside the opposing indentations is preferably greater than the diameter of the guide pin arranged in the guide path. As a result of the indentations, the guide path can be divided into sections, wherein it is preferred that the guide pin can only be moved between the sections by applying force. The sections are preferably selected such that at least one section defines the locked position, and one section defines the released position of the securing unit.

The base part of the securing unit is preferably arranged between the fastening arms. In this case, it is particularly preferred that the base part is arranged at a distance from the fastening arms at least in the region of the guide pins. In this context, it is of particular advantage if fastening arms can be elastically bent in the direction of the base part.

The latching element may have a projecting section with which the latching element projects beyond the plug-in side of the connector housing. In this case, it is preferred that the projecting section runs parallel to the plug-in direction and projects beyond the plug-in side in the plug-in direction. The latching element can moreover have a curved section from which the free end extends. The curved section is preferably arranged at one end of the projecting section which projects beyond the plug-in side of the connector housing. The projecting section and the free end may be arranged parallel to one another or more preferably may together enclose an acute angle. If the plug-in unit has a detachable coding housing, it is particularly preferred that the projecting section is arranged on the coding housing at least in sections.

The bar can be arranged on the projecting section of the latching element. In this case, it may be particularly advantageous if both the bar and the projecting section extend parallel to the plug-in direction.

In the mating connector housing, the mating plug-in unit can have a receiving space in which the plug-in unit and the securing unit can be at least partially inserted. If the plug-in unit has a coding housing, the coding housing can likewise be introduced at least partially into the receiving space. The deflection element can be arranged within the receiving space so that the base part of the securing unit is deflected as soon as the base part is introduced into the receiving space.

The mating connector housing can have a second clip which forms a second passage. The second passage can be connected to the receiving space, or the second passage can be understood as a subregion of the receiving space. At this point, it is particularly preferred that the deflection element is arranged within the second passage. The deflection element may, for example, be introduced into the wall of the second clip. At least when the plug-in unit and mating plug-in unit are connected, the latching element can be guided at least partially through the second passage. Furthermore, the latching seat can be arranged in the second clip.

FIG. 1 shows a three-dimensional view of a first embodiment of a plug connector assembly 1 according to the invention. The plug connector assembly 1 has a plug-in unit 3 and a mating plug-in unit 6, wherein the plug-in unit 3 and the mating plug-in unit 6 are separate in the present view. The plug-in unit 3 is connected to a cable 2. The present embodiment is a multicore electrical cable 2. The wires of the cable 2 are electrically conductively connected to a contact element 4. The contact element 4 is partially surrounded by a connector housing 4, wherein the contact element 4 is accessible on a plug-in side 10 of the plug-in unit 3. The mating plug-in unit 6 has a mating contact element 7 which can be electrically conductively connected to the contact element 4. The mating contact element 7 is surrounded by a mating connector housing 8. In the present embodiment, the mating plug-in unit 6 is designed as a circuit board plug and therefore has additional fastening options for arranging the mating plug-in unit 6 on a semiconductor circuit board. The plug-in unit 3 can be connected to the mating plug-in unit 6 via the plug-in side 10. To ensure that the plug-in unit 3 can only be connected to a mating plug-in unit 6 provided for the plug-in unit 3, the plug-in unit 3 has a coding housing 24. In the present embodiment, the coding housing 24 is plugged onto the connector housing 5 and detachably connected to the connector housing 5 via a snap-in connection. In the present embodiment, the coding housing 24 extends beyond the plug-in side 10 of the connector housing 5.

The connector housing 5 has a base side 12 adjacent to the plug-in side 10. A latching element 11 is arranged on the base side 12. The latching element 11 is formed from the same material as and in one piece with the connector housing 5. The latching element 11 has a projecting section 34 which extends away from the base side 12 in a plug-in direction 14 and projects beyond the plug-in side 10. The latching element 11 is arranged in the projecting section 34 on the coding housing 24. The latching element 11 has a curved section 35 at an end facing away from the connector housing 5. Arranged on the curved section 35 is a free end 13 of the latching element 11 which extends at a distance from the base side 12 counter to the plug-in direction 14. In the present embodiment, the free end 13 extends parallel to the base side 12. The free end 13 has a latch 16 on a side 15 facing away from the base side 12. In the present embodiment, the latch 16 is designed as a latching hook. In the present embodiment, the coding housing 24 has a first clip 26 which creates a first passage 25. The free end 13 extends through the first passage 25 at a distance from the first clip 26.

Arranged on the base side 12 is a securing unit 9 which can be moved parallel to the plug-in direction 14 between a released position and a locked position. In the view shown, the securing unit 9 is in a released position. The securing unit 9 has a base part 18 which is arranged partially between the free end 13 and the base side 12. The base part 18 likewise extends through the first passage 25. In the present embodiment, the base part 18 is further partially arranged between the projecting section 34 and the free end 13. The securing unit 9 is guided in guide paths 32 which are introduced into the coding housing 24 with the aid of guide pins 31. A bar 19 is arranged on a side of the projecting section 34 facing the free end 13. The bar 19 runs parallel to the plug-in direction 14. In the view shown, the base part 18 abuts the bar 9 with an end face so that the securing unit 9 cannot be moved out of the released position.

Figure 2:
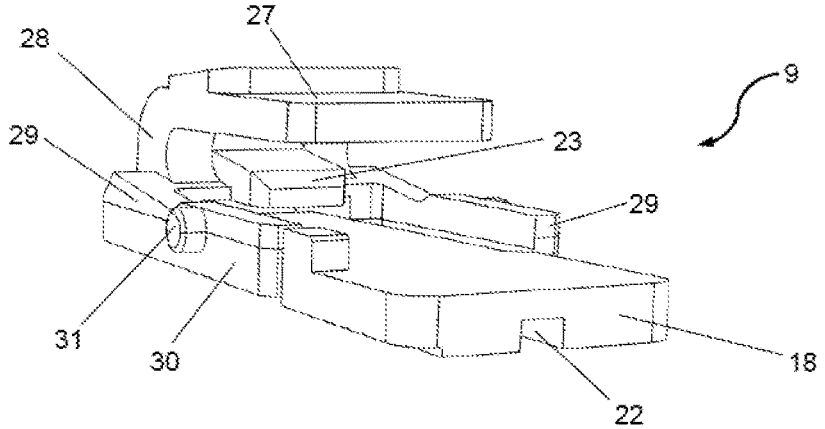
FIGS. 2 and 3 an embodiment of a securing unit of a plug connector assembly according to the invention in three-dimensional views.
Figure 3:
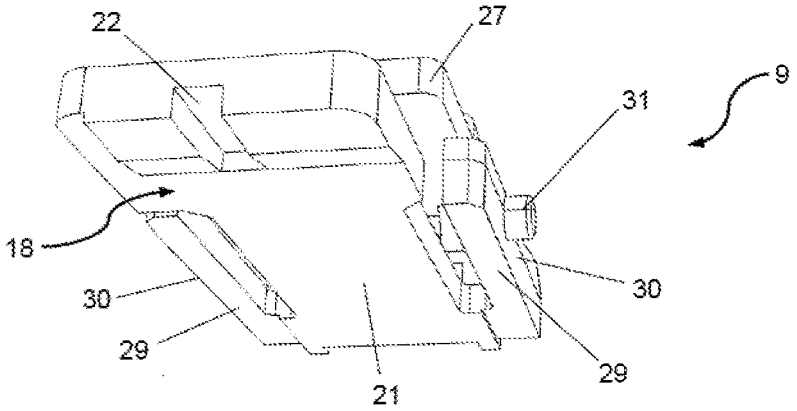

FIGS. 2 and 3 show three-dimensional views of an embodiment of the securing unit 9. This is an embodiment that is used in the first embodiment of the plug connector assembly 1 according to the invention. In addition to the base part 18, the securing unit 9 has a connecting section 28 which connects the base part 18 to a cover part 27 and two fastening arms 29. The cover part 27 extends away from the connecting section 28 at a distance from the base part 18 in the plug-in direction. Furthermore, a locking element 23, which likewise extends away from the connecting section 28, is arranged between the cover part 27 and the base part 18. The fastening arms 29 are arranged parallel to each other and parallel to the base part 18. The base part 18 is arranged between the fastening arms 29. The fastening arms 29 are arranged at a distance from the base part 18. Both fastening arms 29 have a guide pin 31 on a side 30 facing away from the respective other fastening arm 29. The fastening arms 29 are designed to be elastic so that they can be moved toward the base part 18. The base part 18 has a groove 22 on a side 21 facing the base side 12 in the installed state.

Figure 4:
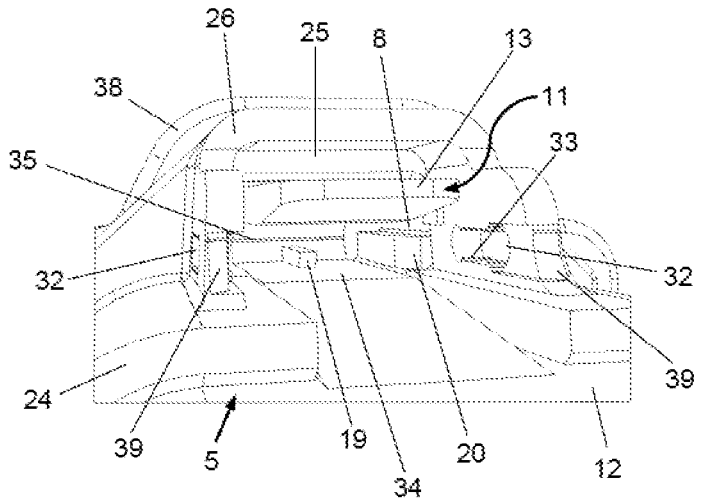
FIGS. 4 and 5 three-dimensional views of the first embodiment of the plug connector assembly according to the invention in the region of a base side.
Figure 5:
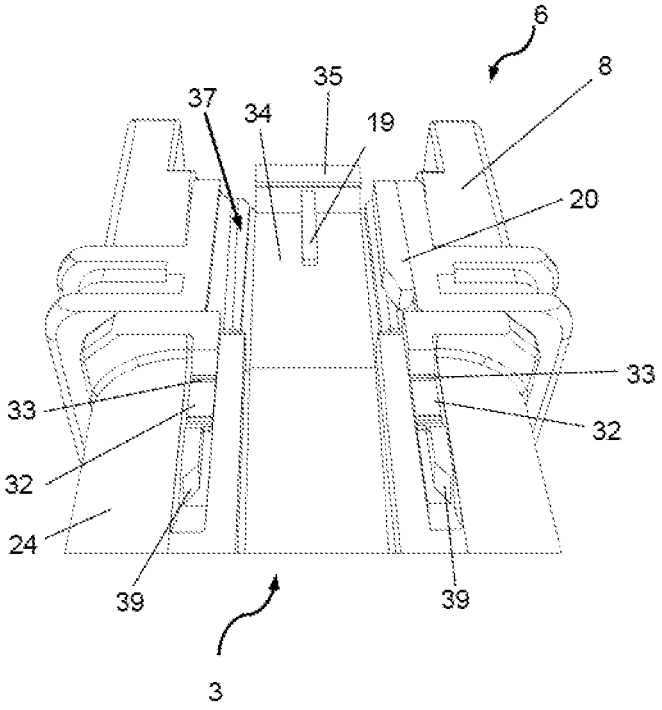

FIGS. 4 and 5 show three-dimensional views of the first embodiment of the plug connector assembly 1 according to the invention in the region of the base side 12, wherein, in FIG. 5, a cut has been made parallel to the plug-in direction in the region of the first clip 26 for a better overview. Furthermore, for a better overview, the securing unit has been removed. The plug-in unit 3 is connected to the mating plug-in unit 6. The mating connector housing 8 has a second clip 38 which forms a second passage 37. When the plug-in unit 3 and mating plug-in unit 6 are connected, the latching element 11 extends through the second passage 37. In the present exemplary embodiment, the bar 19 is arranged centrally on the projecting section 34 of the latching element 11. The guide paths 32 introduced into the coding housing 24 have opposing indentations 33 which define the position of the locked position and the released position. In order to facilitate the insertion of the guide pins into the guide paths, the coding housing 24 has insertion aids 39. In the present embodiment, a deflection element 20 is arranged in the second passage 37 on a wall of the second clip 38. In the present embodiment, the deflection element 20 is a lead-in chamfer that protrudes into the second passage 37. If the securing unit is inserted into the second passage 37, the base part strikes the deflection element 20 and, in the present embodiment, is deflected to the left as viewed from the plug-in direction.

Figure 6:
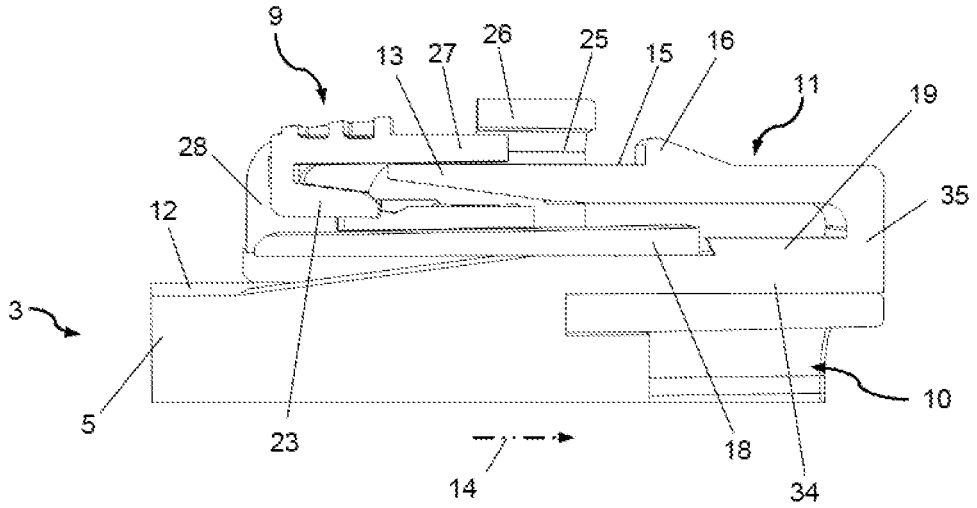
FIG. 6 a sectional view of the first embodiment of the plug connector assembly according to the invention with the securing unit in a released position.

FIG. 6 shows a sectional view of the first embodiment of the plug connector assembly 1 according to the invention. The sectional plane runs parallel to the plug-in direction through the bar 19. The securing unit 9 is in the released position. Furthermore, there is no connection between the plug-in unit 3 and the mating plug-in unit. The free end 13 of the latching element 11 is partially arranged between the cover part 27 and the base part 18. Since the cover part 27 extends into the first passage 25, the free end 13 can only be actuated indirectly via the cover part 27 of the latching element 11. This is done by, for example, an installer pressing on the cover part 27 toward the base side 12. The cover part 27 thus presses on the free end 13 and moves it likewise toward the base side 12. In the released position, the locking element 23 is arranged relative to the free end 13 in such a way that the free end is guided past the locking element 23 when the cover part 27 is pressed. Since the plug-in unit 3 is not connected to the mating plug-in unit, the securing unit 9 cannot be moved into the locked position since the bar 19 abuts the base part 18.

Figure 7:
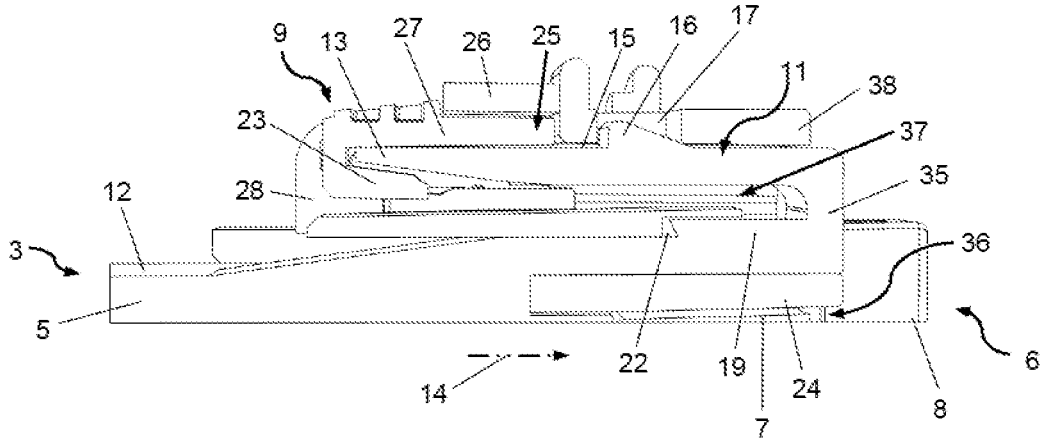
FIG. 7 a sectional view of the first embodiment of the plug connector assembly according to the invention with the securing unit in a locked position.

FIG. 7 shows the first embodiment of the plug connector assembly 1 according to the invention according to the sectional view according to FIG. 6, wherein the securing unit 9 is in the locked position. The plug-in unit 3 is connected to the mating plug-in unit 6 and is therefore partially arranged in a receiving space 36 of the mating plug-in unit 6. The latch 16 is arranged in a latching seat 17 and thus creates a form-fitting mechanical connection between the plug-in unit 3 and the mating plug-in unit 6. In the present embodiment, the latching seat 17 is designed as a latching tab that is inserted into the second clip 38. In order to be able to release the connection between the latch 16 and latching seat 17, the free end 13 of the latching element 11 must be moved toward the base side 12 since this would move the latch 16 out of the latching seat 17. However, such a movement is blocked by the securing unit 9 in the locked position. In a process step, the securing unit 9 has been moved into the locked position after a connection was established between the plug-in unit 3 and the mating plug-in unit 6, and the base part 18 was thereby deflected. The groove 22 located in the base part 18 was arranged in alignment with the bar 19 by the deflection; subsequently, the securing unit 9 was moved in the plug-in direction 14 into the locked position, wherein the bar 19 was inserted into the groove 22. In the locked position, the free end 13 of the latching element 11 is arranged between the cover part 27 and the locking element 23. The locking element 23 is furthermore arranged between the base side 12 and the free end 13. If, in the locked position, a force is applied to the cover part 27, for example by an installer, the locking element 23 prevents the free end 13 from being moved toward the base side 12 since the free end 13 abuts the locking element 23.

Figure 8:
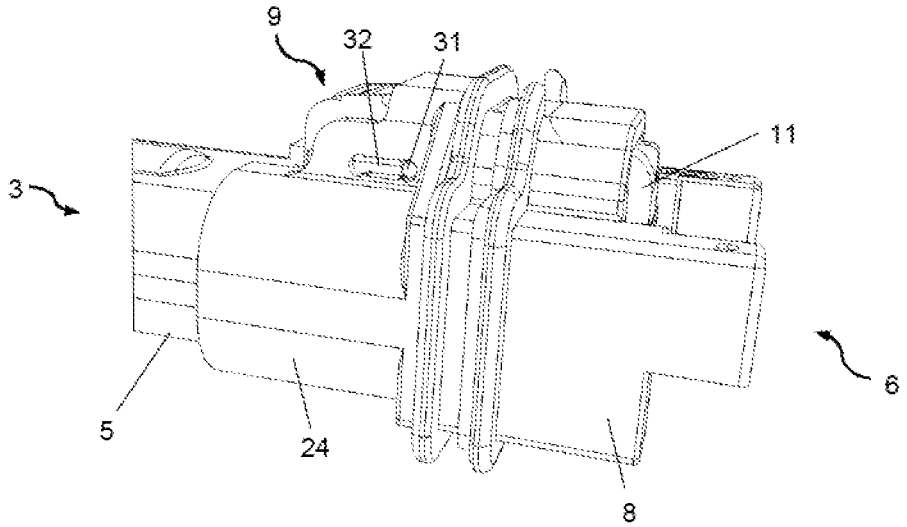
FIG. 8 another three-dimensional view of the first embodiment of the plug connector assembly according to the invention.

FIG. 8 shows the first embodiment of the plug connector assembly 1 according to the invention in a three-dimensional view. In the shown illustration, the plug-in unit 3 is connected to the mating plug-in unit 6. The plug-in securing means 9 is also in the locked position.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 Plug-in connector assembly
2 Cable
3 Plug-in unit
4 Contact element
5 Connector housing
6 Mating plug-in unit
7 Mating contact element
8 Mating connector housing
9 Securing unit
10 Plug-in side
11 Latching element
12 Base side
13 Free end of the latching element
14 Plug-in direction
15 Side of the latching element facing away from the base side
16 Latch
17 Latching seat
18 Base part
19 Bar
20 Deflection element
21 Side of the base part facing the base side
22 Groove
23 Locking element
24 Coding housing
25 First passage
26 First clip
27 Cover part
28 Connecting section
29 Fastening arms
30 Side of the fastening arm facing away from the other fastening arm
31 Guide pin
32 Guide path
33 Indentations
34 Projecting section
35 Curved section
36 Receiving space
37 Second passage
38 Second clip
39 Insertion aid

What is claimed is:

1. A plug connector assembly for a cable, comprising:

a plug-in unit having at least one contact element and a connector housing at least partially surrounding the contact element;

a mating plug-in unit, the plug-in unit being connectable to the mating plug-in unit on a plug-in side; and a securing unit, wherein the connector housing has a latching element which is arranged on a base side adjacent to the plug-in side and has at least one free end which extends at a distance from the base side and counter to a plug-in direction, wherein, on a side facing away from the connector housing, the free end has a latch which, in a connected position where there is a connection between the plug-in unit and the mating plug-in unit, is configured to latch to a latching seat arranged on the mating plug-in unit, wherein the securing unit is movable between a released position and a locked position, wherein the securing unit has a base part which is arranged at least partially between the free end and the base side, wherein, in the released position, the base part abuts a bar of the plug-in unit in a disconnected state where the plug-in unit and mating plug-in unit are disconnected so that a movement of the securing unit into the locked position is blocked, wherein the mating plug-in unit has a deflection element which is configured to deflect the base part when the plug-in unit is moved to the connected position and to position a groove, arranged in a side of the base part facing the base side, in alignment with the bar, so that the bar is insertable into the groove, and the securing unit is movable into the locked position, and wherein the securing unit has a locking element which, in the locked position, is arranged between the free end and the base side and blocks a movement of the free end toward the base side, and prevents the latch from leaving the latching seat.

2. The plug connector assembly according to claim 1, wherein the plug-in unit has at least one coding housing which at least partially surrounds the connector housing and which is detachably arranged on the connector housing.

3. The plug connector assembly according to claim 2, wherein the coding housing has a first clip forming a first passage, and wherein the free end extends through the first passage.

4. The plug connector assembly according to claim 3, wherein the securing unit has a cover part which is arranged at least partially between the first clip and the free end.

5. The plug connector assembly according to claim 4, wherein the cover part is connected to the base part via a connecting section, and wherein the locking element is arranged on the connecting section.

6. The plug connector assembly according to claim 1, wherein the securing unit has two elastic fastening arms each having a guide pin on a side facing away from the other fastening arm that is guided in a linear guide path of the plug-in unit.

7. The plug connector assembly according to claim 6, wherein the guide path in each case has at least two opposing indentations, and wherein a width of the guide path between the opposing indentations is smaller than the diameter of a respective one of the guide pins arranged in the guide path.

8. The plug connector assembly according to claim 7, wherein the base part is arranged between the fastening arms and at least in the region of the guide pins at a distance from the fastening arms.

9. The plug connector assembly according to claim 1, wherein the latching element has a projecting section with which the latching element projects beyond the plug-in side of the connector housing and a curved section from which the free end extends.

10. The plug connector assembly according to claim 9, wherein the bar is arranged on the projecting section.

11. The plug connector assembly according to claim 1, wherein the mating plug-in unit has a mating connector housing with a receiving space configured to receive the plug-in unit and the securing unit at least partially therein, and wherein the deflection element is arranged within the receiving space.

12. The plug connector assembly according to claim 11, wherein the mating connector housing has a second clip forming a second passage, and wherein the deflection element is arranged inside the second passage.

13. The plug connector assembly according to claim 12, wherein the latching seat is arranged in the second clip.

* * * * *